United States Patent [19]

Poirier

[11] Patent Number: 5,031,920

[45] Date of Patent: Jul. 16, 1991

[54] SHOT PATTERN CHECKER

[76] Inventor: Keith Poirier, P.O. Box 6833, Aloha, Oreg. 97007

[21] Appl. No.: 522,591

[22] Filed: May 14, 1990

[51] Int. Cl.[5] ..... F41J 1/14; F41J 1/16; F41J 5/10

[52] U.S. Cl. ..... 273/371; 273/395; 273/397; 273/404; 273/408; 434/20

[58] Field of Search ..... 273/358, 371, 395, 403, 273/404, 406, 397; 434/20

[56] References Cited

U.S. PATENT DOCUMENTS

| | | | |
|---|---|---|---|
| 3,401,937 | 9/1968 | Rockwood et al. | 273/358 |
| 3,798,796 | 3/1974 | Stauff et al. | 434/20 |
| 4,204,683 | 5/1980 | Filippini et al. | 273/371 |
| 4,534,735 | 8/1985 | Allard et al. | 434/20 |

FOREIGN PATENT DOCUMENTS

| | | | |
|---|---|---|---|
| 0160123 | 11/1985 | European Pat. Off. | 434/20 |
| WO85/03118 | 7/1985 | PCT Int'l Appl. | 434/20 |
| 2156054 | 10/1985 | United Kingdom | 273/358 |

*Primary Examiner*—Benjamin Layno

*Attorney, Agent, or Firm*—Robert L. Harrington

[57] ABSTRACT

A shooting range that has a target chamber position at the target end. A camera on the chamber transmits an image of the target to the shooting end where it is displayed on a screen of a video micrometer. The video micrometer has cross hair reticles that measure a shot pattern generated on the target. The video micrometer has a tape recorder for recording the transmitted image, a printer for printing a hard copy of the pattern, a keyboard for data input, and is connectable to a computer for input of the shot pattern data.

15 Claims, 3 Drawing Sheets

SHOT PATTERN CHECKER

BACKGROUND INFORMATION

1. Field of the Invention

This invention relates to shooting ranges and in particular it relates to apparatus for checking, recording and storing target shot pattern data for weapons and ammunition.

2. Background of the Invention

Shooting or target ranges are used by individuals, manufacturer's, law enforcement agencies, and others to check shot patterns of weapons such as rifles or pistols and the shot pattern of ammunition.

The target ranges have a target that is placed at a known distance from a shooter. The length of the range will vary depending on the need of the user. An individual firing a pistol would be interested in a distance of approximately 25 yards, while an individual firing a high powered rifle would be interested in distances in the range of 100 yards.

The targets are generally of a heavy paper or similar material and most often have a pattern or image imprinted on them. The image may be a square, a circle, a triangle or other shape such as a profile of an animal. The pattern or image provides a reference position on the target.

The shooter aims a weapon, such as a rifle, pistol, bow or crossbow at the image on the target and fires the weapon. By firing several rounds, a pattern commonly referred to as the shot pattern, is created on the target by the bullets or arrows piercing the target.

Most target ranges have facilities built into each range for moving the paper target from the area of a shooter to the opposite end of the range where the target chamber is located. Generally an overhead track with a carrier that a target is clipped to is provided. This allows the shooter to remotely position the target and to retrieve the target after the weapon has been fired to check the resulting shot pattern on the target. This is a safe method, but it is slow, especially when shooting on the longer ranges that are of 75 to 100 yards or more in length.

Most, except for the manufacturer's, are interested in the shot pattern on the target to check the skill of the shooter, to sight in a scope equipped weapon or for practice. Manufacturer's on the other hand, are interested in a weapon's accuracy or the repetitive pattern of ammunition.

Manufacturer's desire permanent records of the shot pattern relating to individual weapons and to batches of ammunition tested. This requires recording information on the individual target or attaching an information sheet to the target detailing items such as serial number, date, shooter, ammunition fired, range, size of pattern and other information that may be pertinent. This recorded information then is filed for future reference. In some cases, the data must be included with the shipment of the weapon. This requires duplication of the records. Similar records are maintained for the shot patterns of tested ammunition.

SUMMARY OF THE INVENTION

The present invention has apparatus for viewing, measuring, storing, and printing target shot pattern data.

Shot patterns are generated on targets in shooting ranges by bullets or arrows piercing the targets from weapons fired at the targets from the shooting bay. The targets generally have an image imprinted on them which gives a shooter a reference to aim at.

A target chamber is positioned, either on a permanent basis or as a portable unit, at the target end of the range. A target feed mechanism is incorporated in the chamber to feed targets to the target area from a supply of continuous targets, either fan folded or on a roll. A camera is mounted in or near the target chamber and is focused on the target area, and thus a target that is positioned at the target area. The camera will transmit an image of the target, and thus a shot pattern generated on the target, to the shooting bay where it is received by a video micrometer and is displayable on its viewing screen. Illuminating lights are provided to illuminate the target area.

The video micrometer has measuring capabilities to measure the shot pattern on the target from the transmitted image received from the camera. The video micrometer is arranged as a portable unit, but it may be installed on a permanent basis. Additionally, the video micrometer has a keyboard for data input to the screen, a tape recorder for recording the screen display, a printer for printing a hard copy of the screen display and is connectable to a computer for input of the displayed data.

The video micrometer has cross hair reticles superimposed on the screen. The reticles are moveable by a joystick control to provide measuring capability of horizontal and vertical dimensions and the diagonal. The measurements are displayed directly on screen.

The keyboard, which has alpha-numeric input capability is utilized for adding additional data relative to the displayed shot pattern.

A projector is mountable on the target chamber to project an image onto plain targets that do not have an image imprinted. With the use of the projector, the image on the target is readily changeable by selecting a different image to be projected.

The present invention affords the user, be it an individual or a manufacturer, the capability of visually viewing, measuring, and storing individual shot patterns generated on a target. Storing the data on tape and/or inputting the data to a computer facilitates rapid retrieval as necessary, with the added benefit of saving time and filing space.

Other objects and advantages will be apparent from the detailed description and the drawings.

DESCRIPTION OF THE PREFERRED EMBODIMENT

Figure 1:
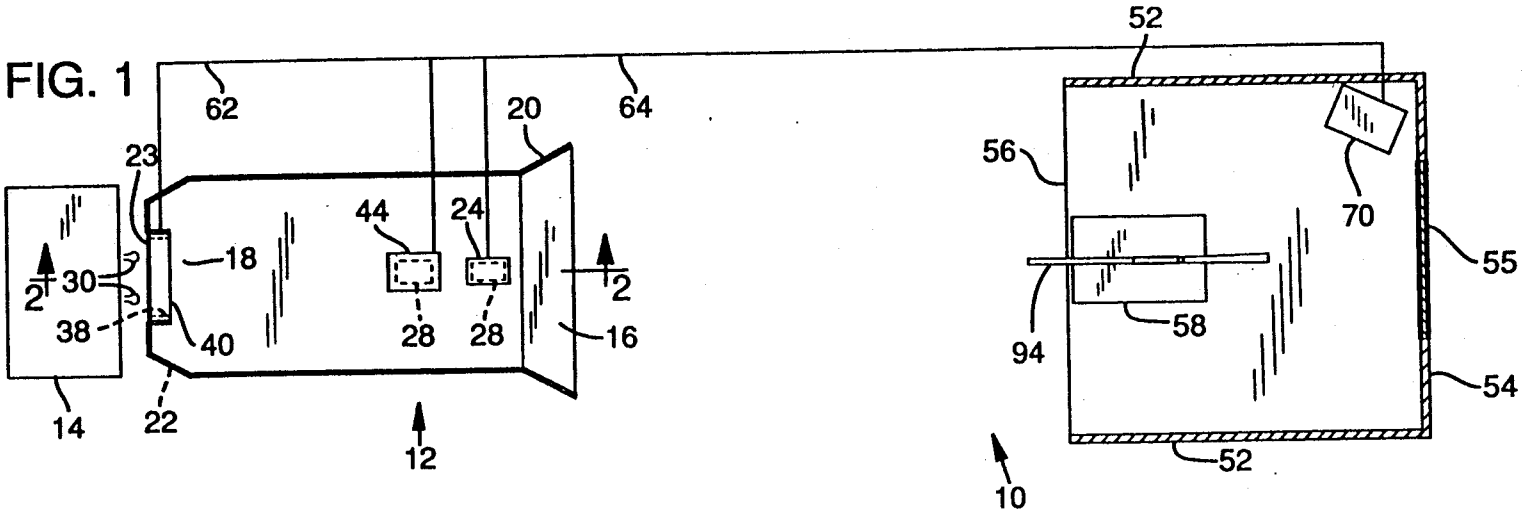
FIG. 1 is a top plan view of a target range incorporating a shot pattern checker system in accordance with this invention.

Referring now to FIG. 1 of the drawings, a target range 10 is used for the firing of weapons at a target 36 that is positioned at a known distance from a shooter. The target range 10 has at one end a target chamber 12 positioned in front of a trap box 14. The target chamber 12 is rectangular in shape having open ends. The target chamber is constructed of heavy gauge, high strength steel. One of the open ends defines an entrance 16 to the chamber and the other open end defines an exit 18. The chamber 12 positioned in front of the trap box 14 has the exit 18 adjacent to the trap box.

The trap box 14 is a large rectangular container that is typically filled with sand. The sand in the trap box 14 will decelerate and trap the bullets that are fired at and through the chamber 12.

Figure 2:
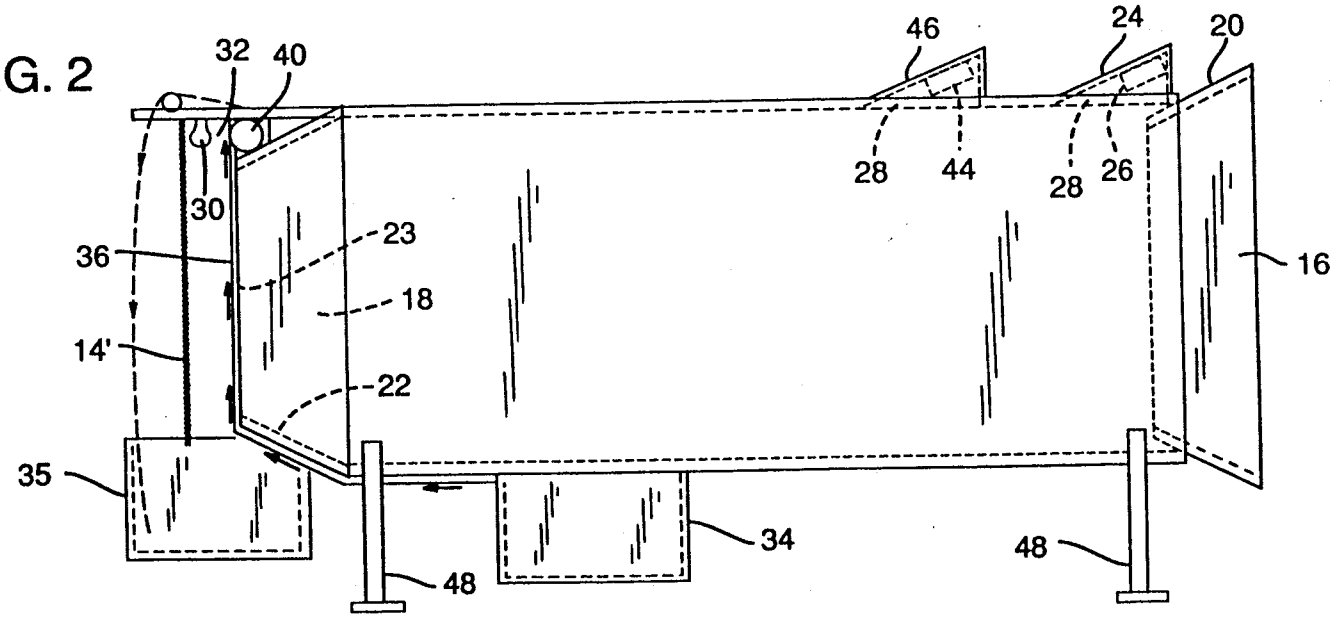
FIG. 2 is a sectional view of a target chamber as viewed on lines 2–2 of FIG. 1.

An alternative to the trap box 14 is a curtain 14' of bullet proof material that is positioned at the exit end of the chamber 12 as shown in FIG. 2. The curtain 14' will decelerate and trap the bullets or arrows fired at and through the chamber.

The target chamber 12 has deflectors 20 on the top, both sides, and bottom of the entrance end 16. As shown in the FIGS. 1 and 2, the deflectors 20 project outwardly at an angle to the chamber 12. An edge of the deflector 20 is rigidly fastened to an edge of an adjacent deflector as by welding. Similar deflectors 22 are provided and secured at the exit end 18 of the chamber. The deflectors 22, however, project inwardly at an angle to the chamber 12. The plane of the opening defined by the ends of the inwardly projecting deflectors 22 is the target area 23.

The target chamber is further illustrated in FIG. 2. A housing 24 configured to receive a video camera 26 is mounted on the top of the chamber 12 over an opening 28 near the entrance end 16. The opening 28 in the top of the chamber 12 is preferably centered between the sides of the chamber near the entrance end 16.

In this embodiment, the camera 26 is mounted on the chamber 12. The camera may be located at other positions. The camera 26 may, for example, be located in the shooting bay and be equipped with a suitable telescopic lens.

A light housing 30 is provided on the end of the chamber 12 near the exit end 18. The light housing 30 contains a light 32 which will provide illumination of the exit end 18 of the chamber and thus a target positioned in the target area.

A dispenser 34 is mounted under the chamber 12 and is attached to the bottom of the chamber. The dispenser 34 is arranged to hold a supply of continuous targets 36 that are either fan folded or supplied on a continuous roll. The targets 36 are joined in an end to end arrangement and have perforated edges 38.

Figure 4:
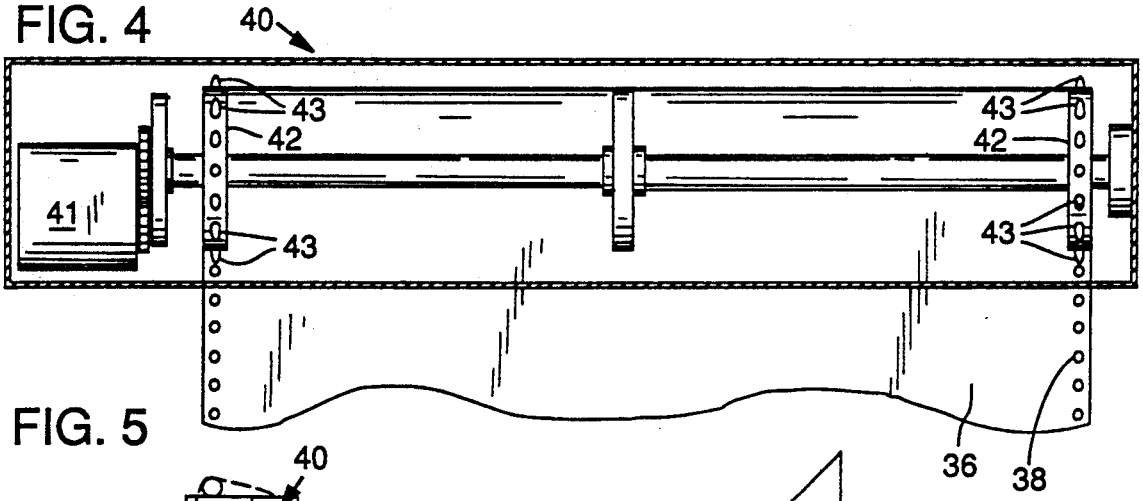
FIG. 4 is a view of the target feed mechanism utilized in the system of FIG. 1.

As seen in FIG. 4, a powered target feed mechanism 40 is mounted on the top of the chamber 12 in the vicinity of the upper deflector 22. The target feed mechanism has tractor wheels 42 that have protruding pins 43 that will engage the perforated edges 38 of the target 36. The tractor feed mechanism is driven by a motor and gear box unit 41. The target feed mechanism is typical of those on the market for feeding paper with perforated edges and further detail will not be given.

Initially, a supply of targets 36 that are connected in an end to end relationship, is placed in the dispenser 34. The top target 36 in the supply is fed (with succeeding targets following) out of the dispenser 34 along the bottom of the chamber 12, around the bottom deflector 22, past the target area 23 and up to the powered feed mechanism 40 where the leading edge of the target is inserted into the feed mechanism with pins 43 on the tractor wheels 42 engaging the perforated edges 38 of the target 36. The feed mechanism is adjusted so that the target 36 is properly positioned at the target area 23.

A receptacle 35 is mounted on the chamber 12 for receiving the used targets that exit from the target feed mechanism 40. As shown in FIG. 2, the receptacle 35 is mounted on the lower portion of the chamber 12 near the exit end 18.

Each target 36 has an image or pattern imprinted on its face. The image is generally centrally positioned on the target and may have a shape to suit. As an alternative to imprinted targets 36, plain targets 36' without patterns or images imprinted are utilized.

To utilize the plain targets 36', a projector 44 is mounted on the top of the chamber 12 in housing 46 (that is mounted over another opening 28) in the vicinity of the camera 26. The projector 44 is used to project an image or pattern on the target 36' located at the target area 23. With the use of the projector 44, a different image or pattern may be projected on the target 36' as desired.

The utilization of a projector 44 projecting an image on a plain target greatly reduces the target cost.

Legs 48 rigidly attached to the bottom of the chamber 12 are provided to support the chamber and also to provide the proper elevation.

Referring back to FIG. 1, the target range 10 has a shooting bay 50 at the end opposite the target chamber 12. As shown, the bay 50 is typically a semi-enclosed area having side walls 52 and an end wall 54 with an open side 56 facing the target chamber 12 at the other end of the range. The end wall 54 has a doorway 55. The bay 50 is usually provided with a bench 58 (or pedestal) for the convenience of a shooter. The bench for example, permits a shooter to fire from the prone position.

Figure 3:
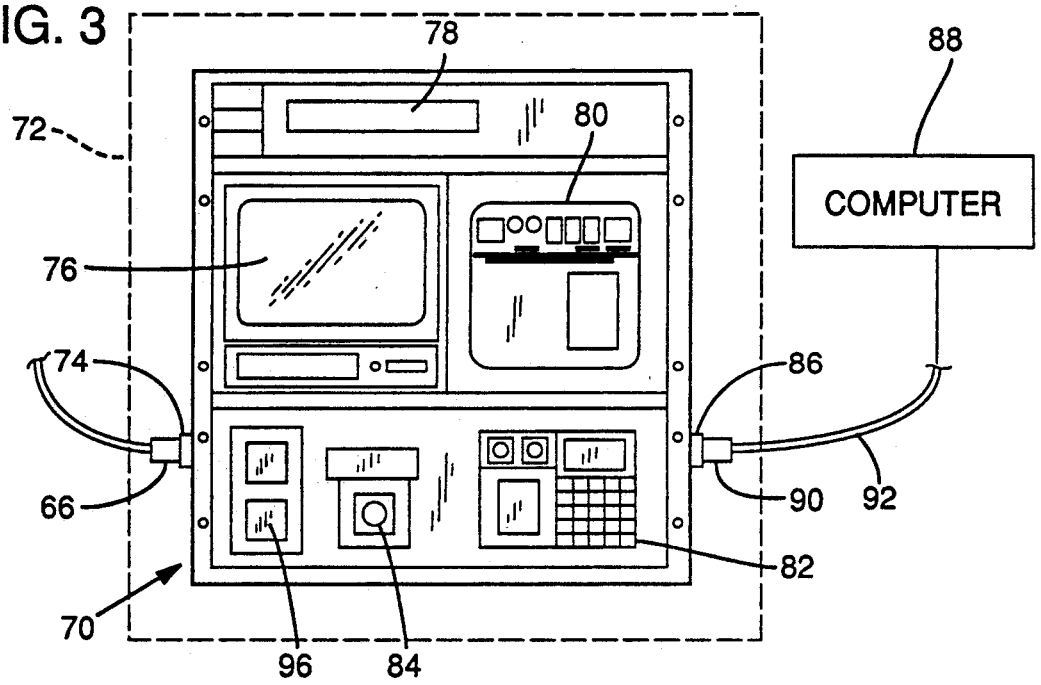
FIG. 3 is a view of a panel of a video micrometer used in the system of FIG. 1.

A connecting cable 64 is provided to inter-connect the camera 26, lights 32, feed mechanism 40 and projector 44 with the video micrometer 70. A quick disconnect coupling 66 at the end of the cable at the bay 50 is connectable to a video micrometer 70 (shown more specifically in FIG. 3). The video micrometer 70 is preferably portable. A case 72 is provided for transporting and storing the video micrometer.

The video micrometer 70 has a quick disconnect coupling 74 that is connectable with the coupling 66 on the cable 64. The video micrometer incorporates a visual display screen 76, a video tape recorder 78, a printer 80, a keyboard 82, a joystick control 84 and a control station 96. A coupling 86 is provided for output of data from the video micrometer.

The visual display screen 76 displays the image transmitted by the camera 26 located in the chamber 12. The video micrometer 70 incorporates a dual cross hair generator that provides double cross hair reticles which are displayed on the screen 76 and are adjustable for position and span between lines. The video micrometer provides field-of-view measuring capabilities for horizontal (X), vertical (Y), and diagonal (d) distances between the displayed lines and opposing corners. The measurements are displayable on the screen 76. The adjustment of the reticles is controlled by the joystick control 84.

A video tape recorder 78 is provided in the video micrometer. The tape recorder will record the image on the screen 76.

A printer 80 in the video micrometer is utilized to print a hard copy of the image on the screen 76.

The keyboard 82 is utilized to input data to be displayed on the screen 76. The keyboard has alphanumeric input capability and is used to input such data as weapon serial number, name of shooter, date, range number and/or other pertinent data.

An electrical control station 96 is provided on the video micrometer. The control station 96 has circuitry and switches to provide power to and to control the operation of the camera 26, light 32, feed mechanism 40, and projector 44. The electrical cable 64 interconnects the video micrometer with the camera, lights, target feed mechanism and projector.

The video micrometer is connectable to a computer 88 by attaching a coupling 90 on connecting cable 92 to the coupling 86 (RS232) on the video micrometer. The data may then be input to the computer 88.

To use the target range 10, a user will connect the video micrometer 70 to the cable 64 which will connect it to the camera, target feed, projector and lights in the chamber 12. The cable 92 will be connected to the coupling 90 to interconnect the video micrometer 70 to the computer 88.

The camera 26, lights 32, feed mechanism 40 and if utilized, the projector 44 will be activated by the switchgear on control station 96. The video micrometer 70 is turned on and the image displayed on the screen 76 is visually checked. This will ascertain that a new target is in position, the camera is properly focused and the reticles are in their zero position.

Should plain targets 36' be in use, the projector will be turned on and a projected image selected.

The shooter is now ready to fire a weapon 94 at the target 36 (or 36') that is positioned at the target area 23 in the target chamber 12. After firing a round, the shooter may visually check the position of the shot pattern on the target by visually looking at the display screen 76. If desired, the amount of offset or distance from the aimed at point may be measured by using the joystick to position the reticles at the position of the image of the shot pattern on the display screen. The distance will be displayed on the screen. Being able to check the pattern visually and actually obtaining a measurement is a rapid method of sighting in a scope on a rifle for example.

After a number of rounds have been fired, a shot pattern is generated on the target that is measurable as stated above.

The shot pattern may be permanently stored by the tape recorder recording the visual display onto tape. Prior to storing the displayed data, added data may be input via the keyboard. The added data may include the range number, date, name of shooter, ammunition fired, serial number of weapon, and any other pertinent data.

Should a copy of the shot pattern be desired, the printer 80 will print a hard copy of the displayed data.

The shot pattern data may also be input to the computer 88 for filing and later retrieval.

Figure 5:
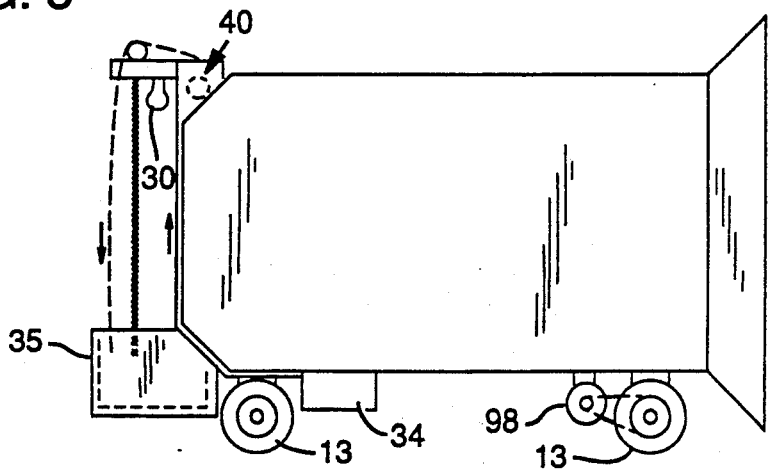
FIG. 5 is an alternate embodiment of the chamber of FIG. 2 having transport wheels to position the target assembly at a distance from shooter.
Figure 6:
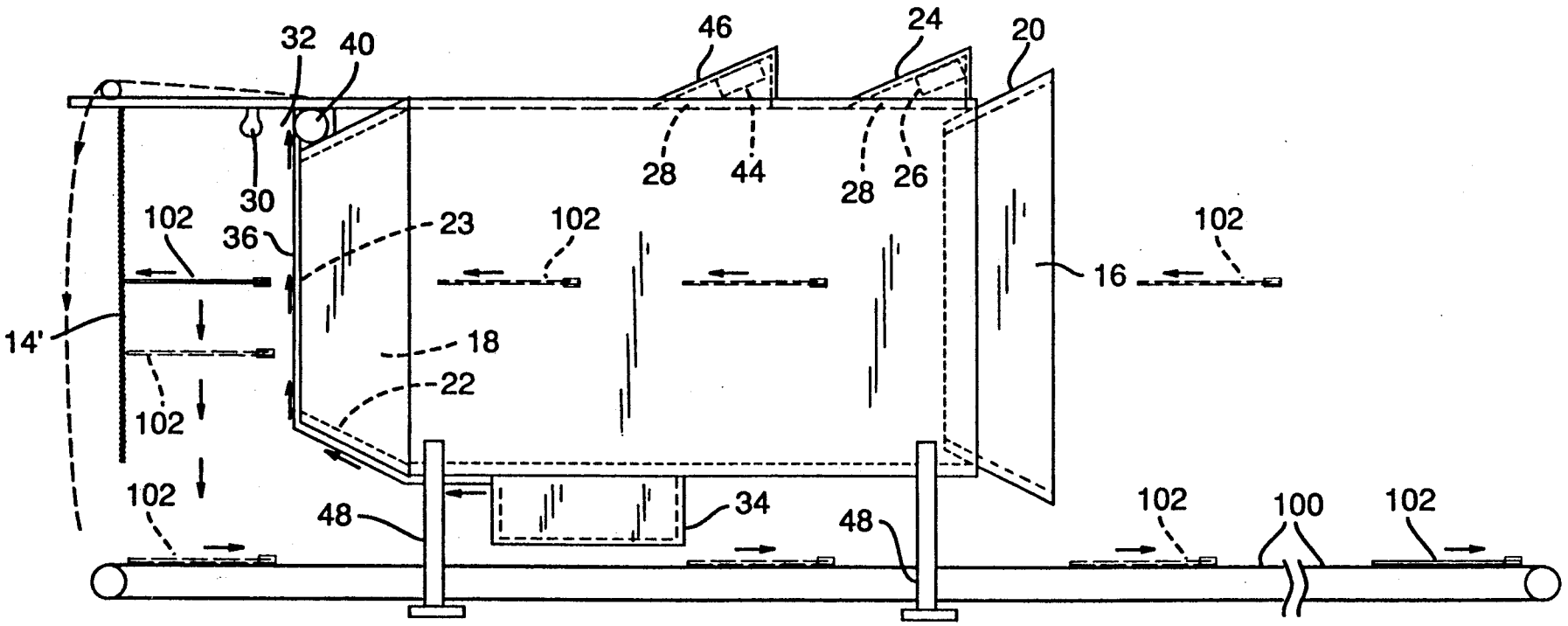
FIG. 6 illustrates the chamber and conveyor for transporting arrows.

As stated previously, the chamber 12 is installable either as a permanent unit or it may be portable. The chamber may be moved to alter the distance from the shooting area to the target area or from one range to another by suitable equipment such as a fork lift truck (not shown). The target chamber 12 may also be provided with wheels 13 as shown in FIG. 5 to provide ease of transport. The target chamber as shown in FIG. 5 has a reversing motor and drive train 98 for positioning the target chamber along the length of the target range 10.

When using a bow, or a crossbow, retrieval of the arrows is required. An option is available that provides a conveyor 100 to transport the arrows 102 back to the shooting bay. An arrow piercing the target will be stopped by the curtain 14', the arrow will fall onto the conveyor and is then transported to the shooting bay.

It will be apparent to those skilled in the art that variations may be made without departing from the true spirit and scope of the invention. The invention is therefore not to be limited to the descriptions and drawings but is to determined from the appended claims.

What is claimed is:

1. A target range having a target end and a shooting end, the target end spaced from the shooting end, a target located at the target end at which ammunition is fired to develop a shot pattern that is to be checked, and the improvement that comprises;

a camera focused on the target area, target positioning means for positioning a sequence of replacement targets at the target area through which ammunition is fired and on which a shot pattern of the point of impingement can be visually observed, a visual display means at the shooting end connected to the camera for receiving and displaying an image of a target at the target positioning means, and measuring means contained in said visual display means for measuring the dimensions of the shot pattern developed on the target as displayed on the visual display means.

2. A target range as defined in claim 1 wherein a target chamber is positioned at the target end, the target area is provided at an end of the target chamber, and the camera is focused on the target area.

3. A target range as defined in claim 2 wherein the target positioning means comprises an inter-connected sequence of targets and a target feed mechanism for automatic feeding of the targets to the target end of the chamber.

4. A target range as defined in claim 3 wherein a target range having a target end and a shooting end, the target end spaced from the shooting end, a target area at the target end and the improvement that comprises;

a camera focused on the target area, a target positioning means for positioning a sequence of targets at the target area on which a shot pattern can be visually observed, a visual display means at the shooting end connected to the camera, and measuring means for measuring a displayed image on the visual display means, the measuring means including movable reticles superimposed on the visual display means and control means for controlling movement of the reticles.

5. A target range as defined in claim 4 wherein the visual display means includes manual input means for inputting data to be displayed on the visual display.

6. A target range as defined in claim 5 including a printer connected to the visual display means for printing a hard copy of the display on the visual display means.

7. A target range as defined in claim 6 including a recorder for recording the image displayed.

8. A target range as defined in claim 7 wherein the recording means is a video tape recorder.

9. A target range as defined in claim 7 wherein the recording means is a computer.

10. A target range as defined in claim 7 including a projector that is mounted on the chamber for projecting an image on the target positioned at the target area.

11. A target range as defined in claim 2 wherein a disconnectable connecting means connects the visual display means to the camera, said visual display means being portable whereby a single visual display means is movable between a plurality of target ranges.

12. A target range as defined in claim 2 wherein the chamber is transportable for selectively varying the distance between the target end and shooting end and for selectively moving the chamber between a plurality of target ranges and the camera is mounted on the chamber.

13. A target range as defined in claim 12 wherein the target positioning means is mounted to the chamber and comprises an interconnected sequence of targets and a target feed mechanism for automatically feeding the targets to the target end of the chamber.

14. A target range as defined in claim 2 including a bullet proof curtain that is mounted on the target end of the chamber.

15. A target range as defined in claim 14 including a conveyor for transporting an arrow from the target end of the range to the shooting end.

* * * * *